US010652956B2

(12) United States Patent
Heubach et al.

(10) Patent No.: US 10,652,956 B2
(45) Date of Patent: May 12, 2020

(54) PERSONAL CONSUMER PRODUCT WITH THERMAL CONTROL CIRCUITRY AND METHODS THEREOF

(71) Applicant: The Gillette Company LLC, Boston, MA (US)

(72) Inventors: Klaus Heubach, Koenigstein (DE); Timo Schmitt, Hintertiefenbach (DE); Benjamin Niestroj, Kronberg (DE)

(73) Assignee: The Gillette Company LLC, Boston, MA (US)

( * ) Notice: Subject to any disclaimer, the term of this patent is extended or adjusted under 35 U.S.C. 154(b) by 972 days.

(21) Appl. No.: 15/189,289

(22) Filed: Jun. 22, 2016

(65) Prior Publication Data

US 2017/0374710 A1 Dec. 28, 2017

(51) Int. Cl.

| | |
|---|---|
| ***H05B 1/02*** | (2006.01) |
| ***B26B 21/40*** | (2006.01) |
| ***B26B 21/48*** | (2006.01) |
| ***H01C 7/02*** | (2006.01) |

(52) U.S. Cl.
CPC ..... *H05B 1/0202* (2013.01); *B26B 21/4056* (2013.01); *B26B 21/48* (2013.01); *H01C 7/02* (2013.01); *H05B 1/0252* (2013.01)

(58) Field of Classification Search
CPC .... B26B 21/48; B26B 21/165; B26B 21/4056
USPC .... 30/34.05, 42, 77, 526; 219/385, 386, 520
See application file for complete search history.

(56) References Cited

U.S. PATENT DOCUMENTS

| | | | |
|---|---|---|---|
| 5,653,025 | A | 8/1997 | Cheng et al. |
| 8,183,940 | B2 | 5/2012 | Koyama et al. |
| 8,186,063 | B2 | 5/2012 | Clarke |
| 8,481,898 | B2 | 7/2013 | Parker |
| 8,772,679 | B2 | 7/2014 | Novikov |
| 9,071,073 | B2 | 6/2015 | Bourilkov et al. |
| 2006/0070242 | A1 | 4/2006 | Szczepanowski et al. |
| 2006/0123631 | A1 | 6/2006 | Szczepanowski et al. |
| 2012/0205362 | A1 | 8/2012 | Etzkorn et al. |
| 2012/0255942 | A1 | 10/2012 | Vodvarka |

(Continued)

FOREIGN PATENT DOCUMENTS

| | | |
|---|---|---|
| DE | 202009003889 | 5/2009 |
| GB | 2323224 | 9/1998 |

OTHER PUBLICATIONS

PCT International Search Report with Written Opinion in corresponding international application PCT/US2017/037419 dated Sep. 8, 2017.

(Continued)

*Primary Examiner* — Tu B Hoang
*Assistant Examiner* — Thomas J Ward
(74) *Attorney, Agent, or Firm* — John M. Lipchitz

(57) ABSTRACT

A personal consumer product having an energy emitting element in selective electrical communication with a power source is provided. Thermal control circuitry is used to isolate the energy emitting element from the power source when a temperature of the energy emitting element exceeds a threshold. The thermal control circuitry includes a primary thermal control circuit and a redundant thermal control circuit. Methods for controlling the temperature of an energy emitting element of a personal consumer product are also provided.

7 Claims, 10 Drawing Sheets

(56) References Cited

U.S. PATENT DOCUMENTS

| | | | | |
|---|---|---|---|---|
| 2014/0114301 | A1 | 4/2014 | Solomon et al. | |
| 2015/0068043 | A1 | 3/2015 | Gester et al. | |
| 2015/0122899 | A1 | 5/2015 | Kaneko et al. | |
| 2015/0197019 | A1 | 7/2015 | Hodgson et al. | |
| 2015/0197021 | A1* | 7/2015 | Hodgson | B26B 21/48 30/34.05 |

OTHER PUBLICATIONS

U.S. Appl. No. 15/189,282, filed Jun. 22, 2016, Klaus Heubach et al.

* cited by examiner

PERSONAL CONSUMER PRODUCT WITH THERMAL CONTROL CIRCUITRY AND METHODS THEREOF

FIELD OF THE INVENTION

The present disclosure provides for a personal consumer product having an electrically driven energy emitting element.

BACKGROUND OF THE INVENTION

Products having electrically driven heating features are prevalent. Such products can be found in cars, homes, and offices. Many such heaters require that they quickly reach a requested or preset target temperature but do not significantly exceed the temperature. It is commonly expected that heating devices are safe, especially for personal consumer products.

Various methods are currently utilized in an attempt to achieve the requisite levels of safety and performance. For example, many kitchen appliances, such as kettles, cooking plates, irons, and coffee makers, use thermal fuses or circuit breakers. Due to their relatively large size, thermal fuses or circuit breakers are typically used in products of sufficient size to house these electrical components without detracting from the desired form factor of the product.

Another approach to increase the safety of a heating device is to use control circuitry for temperature regulation, with the control circuitry using an input from a temperature sensor. However, in case of a failure of the control circuit and/or the temperature sensor, the heating element may undesirably experience excessive heating. Yet another approach to increasing the safety of heating devices is to control the generated heat through the use of self-limiting heating elements that have a positive temperature characteristic, sometimes referred to as "PTCs," which increase in electrical resistance as temperature increases. Thus, a PTC is self-limiting at a certain temperature since, when driven by a constant voltage source (e.g., a battery), the temperature stabilizes at a certain value because the supplied power ($P=V^2/R$) decreases with the increasing temperature until it is in balance with the dissipated power. This technique can be used, for example, for a heated car mirror, certain hair stylers, and other household appliances. However, even though PTC-based devices are self-limiting, they can undesirably take a relatively long period of time to reach the steady state temperature, as providing power to the PTC element slows down as it comes closer to the steady state temperature.

Thus, it would be advantageous to provide for a product with heating features that addresses one or more of these issues. Indeed, it would be advantageous to provide for a personal consumer product that provides sufficient heating levels within a desired period of time while maintaining a desired form factor for its use. It would be also advantageous to provide a personal consumer product having circuitry that prevents overheating.

SUMMARY OF THE INVENTION

The present disclosure fulfills the needs described above by, in one embodiment, a personal consumer product comprising a power source and an energy emitting element in selective electrical communication with the power source. The personal consumer product further comprises a first thermal control circuit comprising a first thermal sensor positioned to sense a temperature of the energy emitting element and a first control unit in electrical communication with the first thermal sensor. The first thermal control circuit also comprises a first switching element in electrical communication with the first control unit, the first switching element switchable by the first control unit between a conducting state and a non-conducting state to electrically isolate the energy emitting element from the power source. The first switching element is switched by the first control unit to the non-conducting state when a first sensed temperature of the energy emitting element exceeds a first thermal threshold. The personal consumer product further comprises a second thermal control circuit comprising a second thermal sensor positioned to sense the temperature of the energy emitting element and a second control unit in electrical communication with the second thermal sensor. The second thermal control circuit further comprises a second switching element in electrical communication with the second thermal sensor, the second switching element switchable by the second control unit between a conducting state and a non-conducting state to electrically isolate the energy emitting element from the power source. The second switching element is switched to the non-conducting state by the second control unit when a second sensed temperature of the energy emitting element exceeds a second thermal threshold.

In another embodiment, a method for controlling the temperature of an energy emitting element of a personal consumer device comprises supplying power to the energy emitting element from a power source, wherein a first thermal sensor is positioned proximate to the energy emitting element to sense the temperature of the energy emitting element and generate a first thermal sensor output, and a second thermal sensor is positioned proximate to the energy emitting element to sense the temperature of the energy emitting element and generate a second thermal sensor output. The method also comprises receiving the first thermal sensor output at a first control unit, wherein the first thermal sensor output corresponds to the temperature of the energy emitting element sensed by the first thermal sensor. The method also comprises electrically isolating the energy emitting element from the power source when the temperature of the energy emitting element sensed by the first thermal sensor exceeds a first thermal threshold. The method also comprises receiving the second thermal sensor output at a second control unit, wherein the second thermal sensor output corresponds to the temperature of the energy emitting element sensed by the second thermal sensor. The method also comprises electrically isolating the energy emitting element from the power source when the temperature of the energy emitting element sensed by the second thermal sensor exceeds a second thermal threshold.

In yet another embodiment, a personal consumer product comprises a power source, a user input device, and an energy emitting element in selective electrical communication with the power source. The personal consumer product comprises a first thermal control circuit comprising a first thermal sensor positioned to sense a temperature of the energy emitting element and a first control unit in electrical communication with the first thermal sensor and the user input device, wherein the user input device is to provide a user control signal to the first control unit. The first thermal control circuit also comprises a first switching element in electrical communication with the first control unit, the first switching element switchable by the first control unit between a conducting state and a non-conducting state to electrically isolate the energy emitting element from the power. The first switching element is switched by the first control unit to the non-conducting state when a first sensed temperature of the energy emitting element exceeds an adjustable first thermal threshold, wherein the adjustable first thermal threshold is based on the user control signal. The personal consumer product also comprises a second thermal control circuit comprising a second thermal sensor positioned to sense the temperature of the energy emitting element and a second control unit in electrical communication with the second thermal sensor. The second thermal control circuit further comprises a second switching element in electrical communication with the second thermal sensor, the second switching element switchable by the second control unit between a conducting state and a non-conducting state to electrically isolate the energy emitting element from the power source. The second switching element is switched to the non-conducting state by the second control unit when a second sensed temperature of the energy emitting element exceeds a second thermal threshold.

BRIEF DESCRIPTION OF THE DRAWINGS

The above-mentioned and other features and advantages of the present disclosure, and the manner of attaining them, will become more apparent and the disclosure itself will be better understood by reference to the following description of nonlimiting embodiments of the disclosure taken in conjunction with the accompanying drawings, wherein.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION OF THE INVENTION

The present disclosure provides for personal consumer products having an energy emitting element controlled by one or more thermal control circuits. Various nonlimiting embodiments of the present disclosure will now be described to provide an overall understanding of the principles of the function, design and operation of the personal consumer products. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment may be combined with the features of other nonlimiting embodiments. Such modifications and variations are intended to be included within the scope of the present disclosure.

Figure 1:
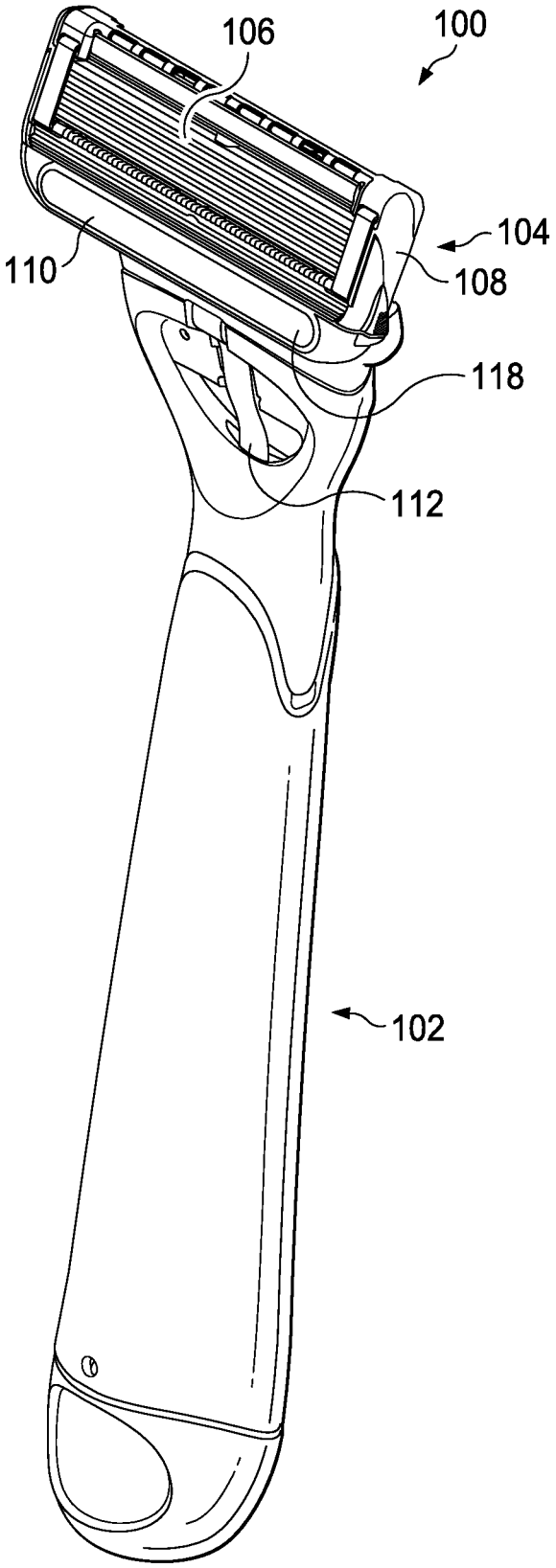
FIG. 1 depicts an exemplary personal consumer product having a heating element.

Referring now to FIG. 1, an exemplary personal consumer product 100 having a heating element is depicted in accordance with one nonlimiting embodiment of the present disclosure. While the personal consumer product 100 is depicted as a wet-shaving razor, such depiction is for illustrative purposes only. Other examples of personal consumer products may include, without limitation, epilators or other hair cutting and/or epilating household devices, toothbrushes, laser hair removal devices, and so forth. Further, while a heating element 110 is depicted, in other embodiments the personal consumer product may additionally, or alternatively, include other types of energy emitting elements. Example energy emitting elements may include light emitting diodes (LEDs), lasers, vibrating or oscillating components, and so forth.

In certain embodiments, the personal consumer product 100 may include a shaving razor cartridge 104 mounted to a handle 102. The shaving razor cartridge 104 may be fixedly or pivotably mounted to the handle 102 depending on the overall desired cost and performance. The shaving razor cartridge 104 may be permanently attached or removably mounted to the handle 102. The shaving razor cartridge 104 may have a housing 108 with one or more blades 106 mounted thereto. The handle 102 may hold a power source (not shown) that supplies power to the heating element 110. Many personal consumer products in accordance with the present disclosure may be battery driven, with some using a rechargeable battery that may be recharged while the personal consumer product is not in use.

The heating element 110 may comprise a metal, such as aluminum or steel. In certain embodiments, the heating element 110 may be a compound of a metallic skin plate and a ceramic bar which carries electrically conducting tracks, with sensors and connection terminals being part of a control circuit in order to electrically connect the heating element 110 to one or more thermal control circuits (i.e., a primary circuit and a redundant circuit) via a flexible conducting band 112. As described in more detail below, the one or more thermal control circuits may regulate current flow through the heating element 110 based on the detection of certain events, such as an excessive temperature event. The transformation of the electrical energy of a power source into thermal energy of the heating element 110 may be done by a resistive layer printed on the surface of a ceramic substrate, such as using thick-film technology. The heating element 110 may comprise a skin contacting surface 118 that delivers heat to a consumer's skin during a shaving stroke for an improved shaving experience. The heating element 110 may be mounted to either the shaving razor cartridge 104 or to a portion of the handle 102. For embodiments alternatively or additionally utilizing a different type of energy emitting element, electrical energy of the power source may be transformed into thermal energy using other techniques, with such thermal energy being a byproduct of light generation or a byproduct of mechanical vibration, for example. In any event, the thermal control circuitry described herein may redundantly detect for excessive heat events and responsively isolate the energy emitting element from the power source to allow for the energy emitting element to cool.

Figure 2:
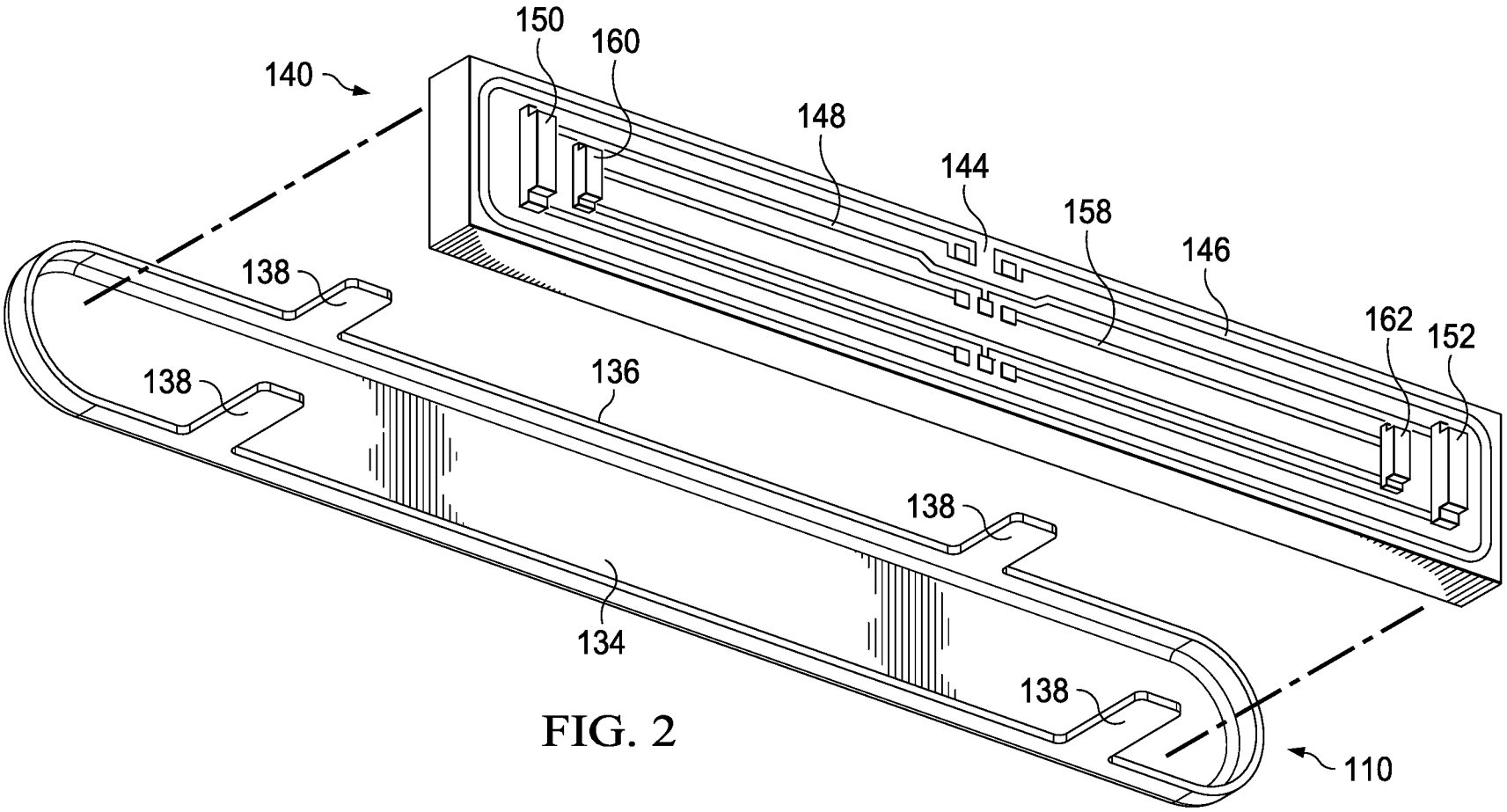
FIG. 2 depicts an exploded view of the heating element shown in FIG. 1.

Referring to FIG. 2, an exploded view of one possible embodiment of the heating element 110 depicted in FIG. 1 is shown. The heating element 110 may have a bottom surface 134 opposing the skin contacting surface 118 (FIG. 1). A perimeter wall 136 may define the bottom surface 134. One or more legs 138 may extend from the perimeter wall 136, transverse to and away from the bottom surface 134. For example, FIG. 2 illustrates four legs 138 extending from the perimeter wall 136. The legs 138 may facilitate locating and securing the heating element 110 during the assembly process. An insulating member 140 may be positioned within the perimeter wall 136. In certain embodiments, the insulating member 140 may comprise a ceramic or other material having high thermal conductivity and excellent electrical insulator properties. The insulating member 140 may have a first surface (not shown) that faces the bottom surface 134 of the heating element and a second surface 144 opposite the first surface. The perimeter wall 136 may help contain and locate the insulating member 140. In certain embodiments, the insulating member 140 may be secured to the bottom surface 134 by various bonding techniques generally known to those skilled in the art. It is understood that the perimeter wall 136 may be continuous or segmented (e.g., a plurality of legs or castellations).

The second surface 144 of the insulating member 140 may comprise a conductive heating track 146 that extends around a perimeter of the insulating member 140. A first electrical circuit track 148 may also extend generally along a perimeter of the second surface 144. In certain embodiments, the first electrical circuit track 148 may be positioned inside of a boundary defined by the heating track 146. The first electrical circuit track 148 may be spaced apart from the heating track 146. The first electrical circuit track 148 may comprise a pair of thermal sensors 150 and 152 that are positioned on opposite lateral ends (e.g., on left and right sides) of the second surface 144 of the insulating member 140. In certain embodiments, the thermal sensors 150 and 152 may be NTC-type thermal sensors (negative temperature coefficient). The first electrical circuit track 148 and the thermal sensors 150 and 152 may be components of a first thermal control circuit serving to detect for excessive heating events of the first electrical circuit track 148.

The second surface 144 of the insulating member 140 may further comprise a second electrical circuit track 158 that may be spaced apart from the heating track 146 and the first electrical circuit track 148. The second electrical circuit track 158 may comprise a pair of thermal sensors 160 and 162 that are positioned on opposite lateral ends (e.g., on left and right sides) of the second surface 144 of the insulating member 140. In certain embodiments, the thermal sensors 160 and 162 may be NTC-type thermal sensors. The second electrical circuit track 158 and the thermal sensors 160 and 162 may be components of a second thermal control circuit serving to redundantly detect for excessive heating events. The thermal sensors 150 and 152 may independently output a signal related to the temperature of the heating element 110 to a first control unit and the thermal sensors 160 and 162 may independently output a signal related to the temperature of the heating element 110 to second control unit. The output signal may be in the form of the thermal sensor's electrical resistance that varies in relation to temperature.

While FIG. 2 depicts the use of four sensors 150, 152, 160, and 162 positioned at opposite lateral ends of the heating element 110, this disclosure is not so limited. For example, in certain embodiments, the first electrical circuit track 148 may include a single sensor and the second electrical circuit track 158 may include a single sensor, with each sensor positioned generally central to the second surface 144 of the insulating member 140. In such arrangements, the sensor of the second electrical circuit track 158 may be considered redundant to the sensor of the first electrical circuit track 148. For some types of heating elements, a single sensor positioned in the middle of the heating element would not be necessary to provide temperature information at certain points along the heating element, such as at the lateral ends. Therefore, in accordance with certain implementations and due to the limited thermal conductance along the heating element 110, the sensors 150, 152, 160, and 162 are positioned at opposite lateral ends of the heating element 110.

Figure 3:
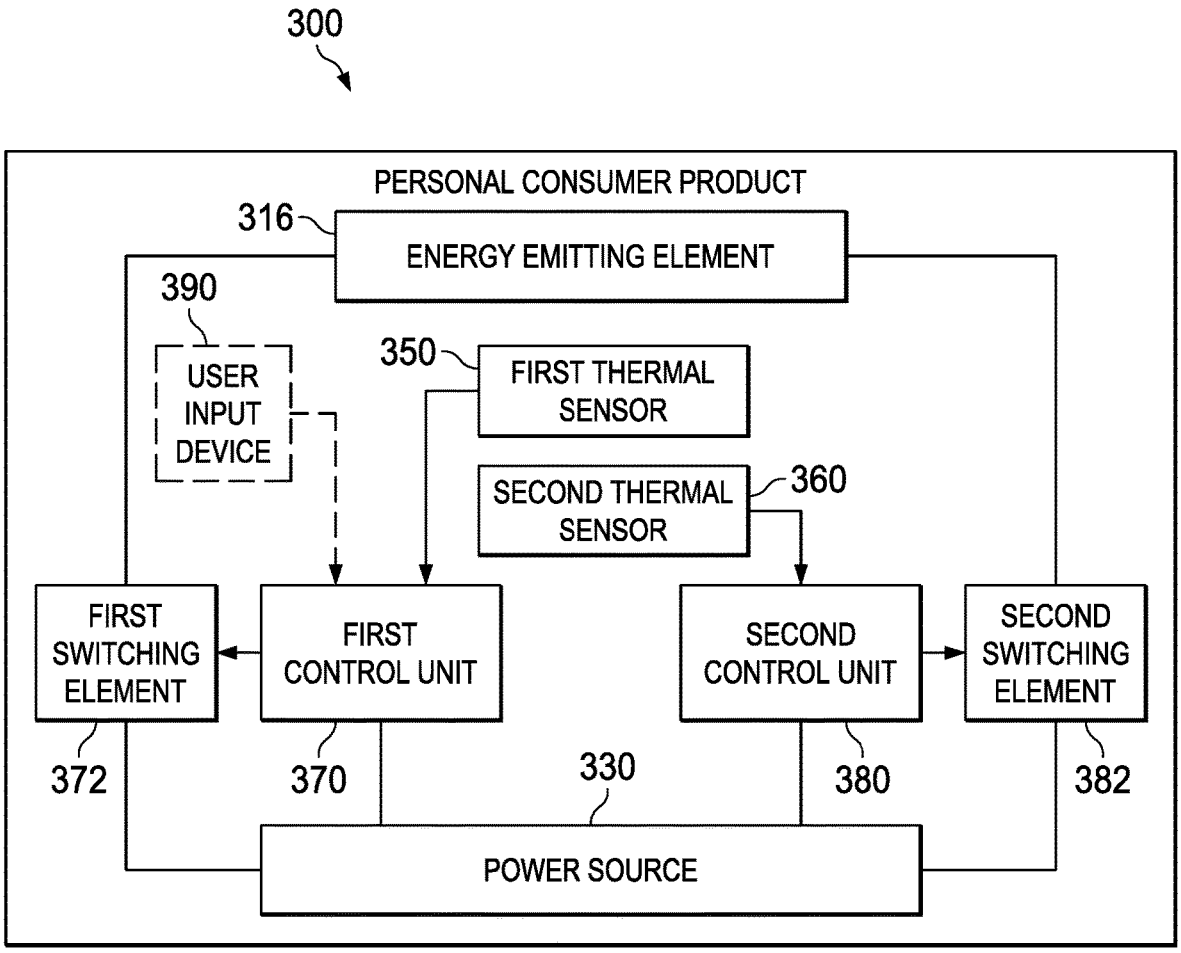
FIG. 3 is a block diagram depicting an example personal consumer product having an energy emitting element in selective electrical communication with a power source.

FIG. 3 is a block diagram depicting an example personal consumer product 300 having an energy emitting element 316 in selective electrical communication with a power source 330. In certain embodiments, such as for wet-shaving razors, the power source may be a battery which may deliver up to 6 Watts of power for the duration of a typical shave and which accommodates enough energy to allow for multiple shaves. One example of a power source is a rechargeable battery, such as a Lithium-Ion cell with a nominal voltage of 3.6 V and a capacity of 680 mAh. In such embodiments, the resistance of the energy emitting element 316 may be about 2.5 Ohms. Other types of personal consumer products may utilize different types of power sources and other types of energy emitting elements may have different resistance levels.

A first thermal sensor 350 is positioned to sense a temperature of the energy emitting element 316. The first thermal sensor 350 is in electrical communication with a first control unit 370. For wet-shaving razors, the first control unit 370 may be positioned within the handle 102 (FIG. 1) and connected to the first thermal sensor 350 via the flexible conducting band 112 (FIG. 1). A first switching element 372 is in electrical communication with the first control unit 370. The first thermal sensor 350, the first control unit 370, and the first switching element 372 may comprise a first thermal control circuit which serves to monitor the sensed temperature of the energy emitting element 316 and detect overheating events. The first switching element 372 may be switchable by the first control unit 370 between a conducting state and a non-conducting state (i.e., a closed state to an open state). When the first switching element 372 is in the non-conductive state, the energy emitting element 316 is electrically isolated from the power source 330 such that current is not delivered to the energy emitting element 316, or the current supply is otherwise decreased. The first switching element 372 is switched by the first control unit 370 to the non-conducting state when a first sensed temperature of the energy emitting element 316 exceeds a first thermal threshold. Depending on the operation of the first control unit 370 and the first switching element 372, various control techniques may be utilized which serve to reduce the temperature of the energy emitting element 316. For example, in some embodiments, the switching of the first switching element 372 between the conductive and non-conductive state utilizes a pulse width modulation (PWM) control scheme. In some embodiments, when the first thermal threshold is exceeded, the first switching element 372 is switched to a non-conductive state for a predetermined period of time before being switched to a conductive state. Thus, when an overheating event is detected (i.e., the first thermal threshold is exceeded), the power being delivered to the energy emitting element 316 is reduced to allow the energy emitting element 316 to cool.

The first thermal threshold may be set or selected using any of a variety of techniques. In certain embodiments, the first thermal threshold is preset for the personal consumer product 300 during manufacturing, such that it is not adjustable. In other embodiments, the first thermal threshold may be user-adjusted. For instance, a user may interact with a user input device 390 to select one of a plurality of thermal thresholds, or otherwise adjust the thermal threshold for the first control unit 370. The user input device 390 may vary, but in some embodiments the user input device 390 comprises an interactive element, such as a button, a dial, a switch, a keypad, a slider, or the like to allow a user to interact with the first control unit 370. In this regard, the user may be presented with a grouping of presets (i.e., such as "low and high", or "low, medium, and high") or the user may be able to incrementally adjust the first thermal threshold between a minimum temperature value and a maximum temperature value.

A second thermal sensor 360 is positioned to also sense a temperature of the energy emitting element 316. The second thermal sensor 360 is in electrical communication with a second control unit 380. For wet-shaving razors, the second control unit 380 may be positioned within the handle 102 (FIG. 1) and connected to the second thermal sensor 360 via the flexible conducting band 112 (FIG. 1). A second switching element 382 is in electrical communication with the second control unit 380. The second switching element 382 may be switchable by the second control unit 380 between a conducting state and a non-conducting state. The second thermal sensor 360, the second control unit 380, and the second switching element 382 may comprise a second thermal control circuit which, similar to the first thermal control circuit, serves to monitor the sensed temperature of the energy emitting element 316 for overheating events. When the second switching element 382 is in the non-conductive state, the energy emitting element 316 is electrically isolated from the power source 330. The second switching element 382 is switched by the second control unit 380 to the non-conducting state when a second sensed temperature of the energy emitting element 316 exceeds a second thermal threshold. Depending on the operation of the second control unit 380 and the second switching element 382, various control techniques may be utilized which serve to reduce the temperature of the energy emitting element 316. When an overheating event is detected by the second thermal control circuit (i.e., the second thermal threshold is exceeded), the power being delivered to the energy emitting element 316 is reduced or ceased to allow the energy emitting element 316 to cool. The second thermal control circuit may generally be redundant to, or a back-up of, the first thermal control circuit, such that should a component of either the first thermal control circuit or the second thermal control circuit fail to operate, the other of the first thermal control circuit or the second thermal control circuit continues to monitor for excessive heat events and takes action should an excessive heat event occur. The first thermal threshold and the second thermal threshold may be independently set. In some embodiments, the thermal thresholds are set at substantially the same temperature whereas in other embodiments one is set at a level higher than the other. For embodiments utilizing the user input device 390 and having a preset maximum temperature value for the first thermal threshold, the second thermal threshold may be set to be higher than the maximum temperature value.

Figure 4:
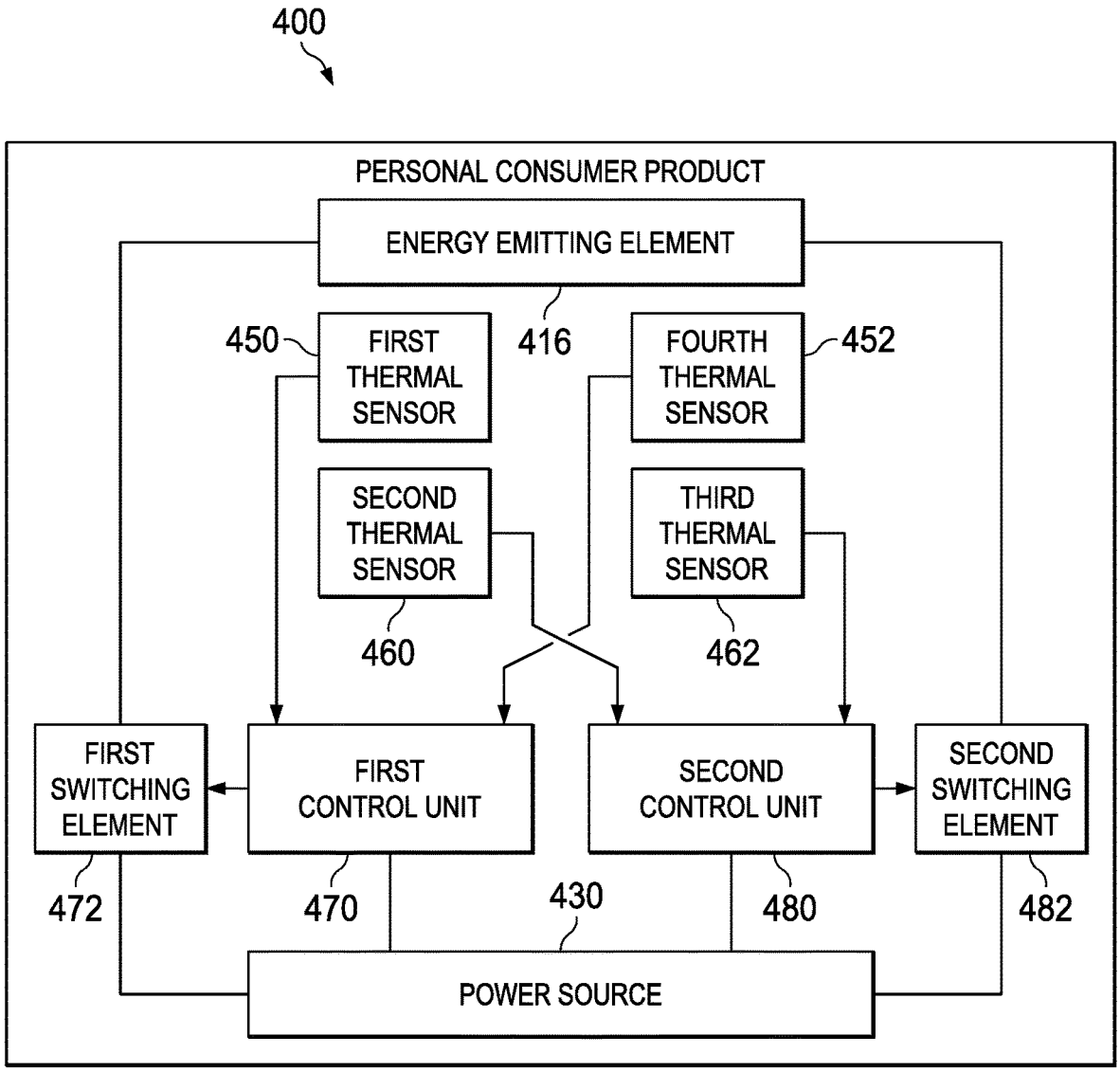
FIG. 4 is a block diagram depicting another example of a personal consumer product having an energy emitting element in selective electrical communication with a power source.

FIG. 4 is a block diagram depicting another example of a personal consumer product 400 having an energy emitting element 416 in selective electrical communication with a power source 430. This embodiment is generally similar to the consumer product 300 depicted in FIG. 3, except each of the first and second thermal control circuits comprise multiple thermal sensors. In some embodiments, each of the thermal sensors of the first thermal control circuit (depicted as first thermal sensor 450 and fourth thermal sensor 452) may be positioned at lateral opposing ends of the energy emitting element 416. Similarly, each of the thermal sensors of the second thermal control circuit (depicted as second thermal sensor 460 and third thermal sensor 462) may also be positioned at lateral opposing ends of the energy emitting element 416. Such thermal sensor arrangement is similar to the arrangement depicted in FIG. 2, for example. The thermal sensor arrangement may be due to the limited lateral thermal conductance of the energy emitting element 416. As compared to the personal consumer product 300 depicted in FIG. 3, the use of multiple thermal sensors 450, 452, 460, and 462 may allow for additional and finer control of the energy emitting element 416, as additional thermal information may be provided to each of a first control unit 470 and a second control unit 480.

The first and fourth thermal sensors 450 and 452 are each positioned to sense a temperature of the energy emitting element 416. Each of the first and fourth thermal sensors 450 and 452 are in electrical communication with the first control unit 470. A first switching element 472 is in electrical communication with the first control unit 470. The first switching element 472 may be switchable by the first control unit 470 between a conducting state and a non-conducting state based on signals received from the first thermal sensor 450 and/or the fourth thermal sensor 452, which may be in the form of a change in resistance, for example. In this regard, if the first control unit 470 detects an overheating event based on signals received from either of the first or fourth thermal sensors 450 and 452, the power being delivered to the energy emitting element 416 is reduced to allow the energy emitting element 416 to cool.

The second and third thermal sensors 460 and 462 are also positioned to sense a temperature of the energy emitting element 416. Each of the first and second thermal sensors 460 and 462 are in electrical communication with the second control unit 480. A second switching element 482 is in electrical communication with the second control unit 480. The second switching element 482 may be switchable by the second control unit 480 between a conducting state and a non-conducting state based on signals received from the second thermal sensor 460 and/or the third thermal sensor 462, which may be in the form of a change in resistance, or other type of signal. In this regard, if the second control unit 480 detects an overheating event based on signals received from either of the second or third thermal sensors 460 and 462, the power being delivered to the energy emitting element 416 is reduced to allow for the energy emitting element 416 to cool. Similar to FIG. 3, the second thermal control circuit of FIG. 4 may generally be redundant to, or a back-up of, the first thermal control circuit, such that should a component of either the first thermal control circuit or the second thermal control circuit fail to operate, the other of the first thermal control circuit or the second thermal control circuit continues to monitor for excessive heat events and takes action should an excessive heat event occur.

Figure 5:
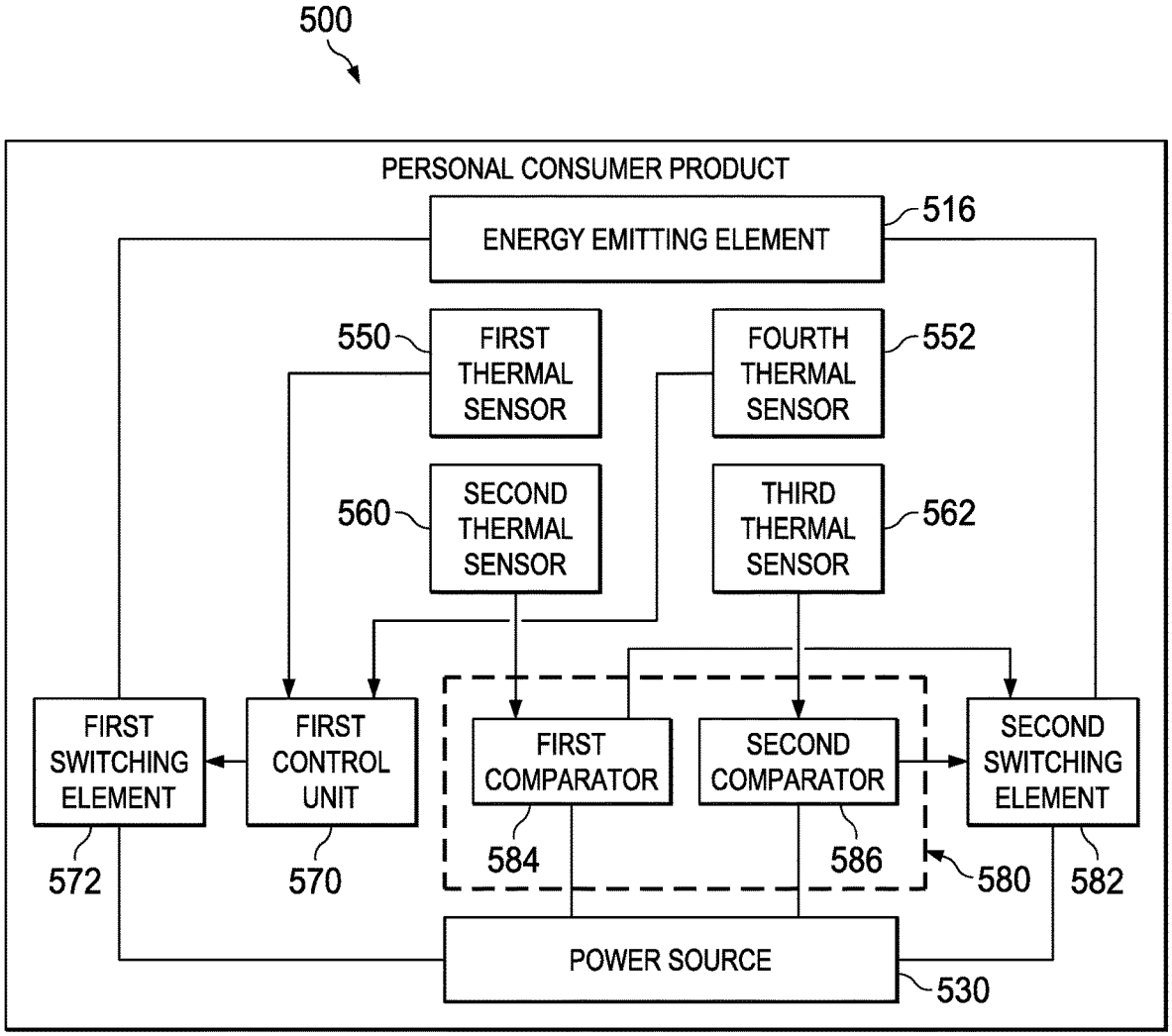
FIG. 5 is a block diagram depicting another example of a personal consumer product having an energy emitting element in selective electrical communication with a power source.

FIG. 5 is a block diagram depicting another example of a personal consumer product 500 having an energy emitting element 516 in selective electrical communication with a power source 530. In this embodiment a second control unit 580 comprises a first comparator 584 and a second comparator 586. Similar to the personal consumer product 400 illustrated in FIG. 4, first and fourth thermal sensors 550 and 552 may each be positioned to sense a temperature of the energy emitting element 516. Each of the first thermal sensor 550 and the fourth thermal sensor 552 are in electrical communication with a first control unit 570.

A first switching element 572 is in electrical communication with the first control unit 570. The first switching element 572 may be switchable by the first control unit 570 between a conducting state and a non-conducting state based on signals received from the first thermal sensor 550 and/or the fourth thermal sensor 552. The first control unit 570 may perform other functions or tasks associated with the operation of the personal consumer product 500, such as managing a user interface, battery charging, voltage monitoring and so on.

In the illustrated embodiment, second and third thermal sensors 560 and 562 are each positioned to also sense a temperature of the energy emitting element 516. The second thermal sensor 560 is in communication with the first comparator 584 and the third thermal sensor 562 is in communication with the second comparator 586. The first comparator 584 and the second comparator 586 are each in communication with a second switching element 582, which may be switchable by either of the first or second comparator 584, 586 between a conducting state and a non-conducting state. In this regard, if either the first comparator 584 or the second comparator 586 detects an overheating event based on signals received from either of the second or third thermal sensors 560 and 562, respectively, the power being delivered to the energy emitting element 516 is reduced to allow for the energy emitting element 516 to cool.

Figure 6:
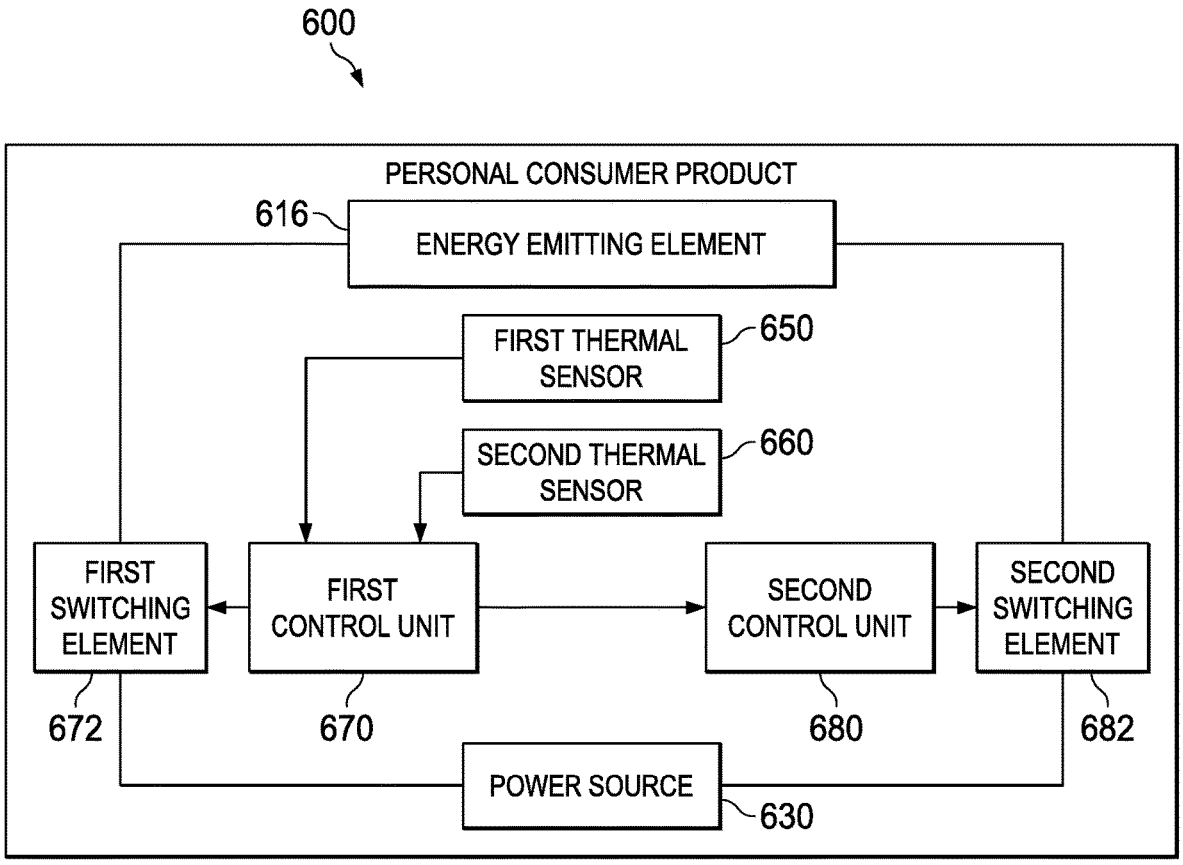
FIG. 6 is a block diagram depicting yet another example of a personal consumer product having an energy emitting element in selective electrical communication with a power source.

While the block diagrams of FIGS. 3-5 depict fully redundant thermal control circuits, in some embodiments, a personal consumer product may utilize partially redundant thermal control. For instance, multiple thermal sensors and multiple switching elements may be used to provide certain levels of redundancy, but the control units are not redundant. Such an approach may be useful to allow for simplified thermal control circuitry, while still providing various redundant safety control features. FIG. 6 is a block diagram depicting an example of a personal consumer product 600 having an energy emitting element 616 in selective electrical communication with a power source 630. In this embodiment, a partially redundant thermal control circuit is used. A first thermal sensor 650 and a second thermal sensor 660 may each be positioned to sense a temperature of the energy emitting element 616. Each of the first and second thermal sensors 650 and 660 are in electrical communication with a first control unit 670. The first control unit 670 may be a microcontroller, for example. The first control unit 670 may be in communication with a second control unit 680. A first switching element 672 is in electrical communication with the first control unit 670. The first switching element 672 may be switchable by the first control unit 670 between a conducting state and a non-conducting state based on signals received from the first thermal sensor 650. A second switching element 682 is in electrical communication with the second control unit 680. The second switching element 682 may be switchable by the second control unit 680 between a conducting state and a non-conducting state based on signals received from the first control unit 670. Upon receiving the signal from the first control unit 670, the second control unit 680 may hold the second switching element 682 in a conductive state for a predetermined period of time. Thus, the second control unit 680 may function as a retriggerable timer that holds the second switching element 682 in a closed position for the predetermined period of time once it receives an activation signal from the first control unit 670. During that period of time, assuming the first switching element 672 is also conductive, the energy emitting element 616 will remain in electrical communication with the power source 630. If the second control unit 680 does not receive a signal from the first control unit 670 during the predetermined period of time, second control unit 680 will transition the second switching element 682 to a non-conductive state (i.e., open the switch) at the end of the period of time, thereby electrically isolating the energy emitting element 616 from the power source 630 and allowing the energy emitting element 616 to cool. Once the activation signal is again received from the first control unit 670, the second control unit 680 will transition the second switching element 682 to a conductive state so that the energy emitting element 616 will again be in electrical communication with the power source 630

Figure 7:
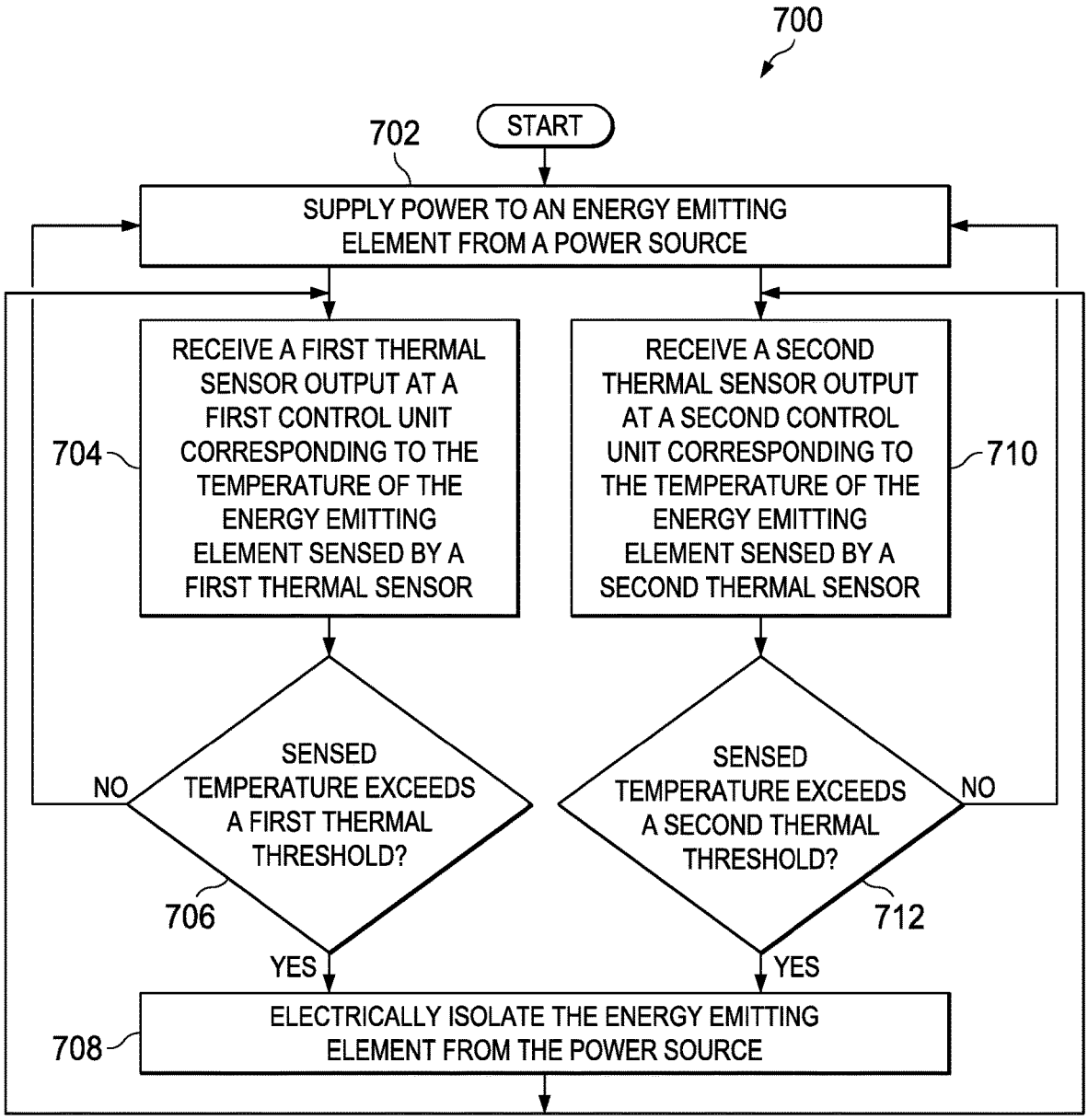
FIG. 7 is a flow chart depicting an operation of an example of a personal consumer product.

Referring now to FIG. 7, a flow chart 700 depicts an example operation of a personal consumer product in accordance with one non-limiting embodiment. At block 702, power is supplied to an energy emitting element from a power source. The energy emitting element may be, without limitation, a heating element, a LED, or a vibrating element. The power may be supplied by a battery, or other suitable power source. At block 704, a first control unit receives a first thermal sensor output that corresponds to the temperature of the energy emitting element. The first thermal sensor output may be, for example, a voltage level that fluctuates based on the temperature of the first thermal sensor. The first thermal sensor may be positioned proximate to the energy emitting element such that it generates an output proportional to, or at least correlated to, the temperature of the energy emitting element. At block 710, and generally concurrently with block 704, a second control unit receives a second thermal sensor output that also corresponds to the temperature of the energy emitting element. The second thermal sensor may be positioned proximate to the energy emitting element such that it also generates an output proportional to, or at least correlated to the temperature of the energy emitting element. At block 706, it is determined whether the sensed temperature at the first thermal sensor exceeds a first thermal threshold. The first thermal threshold may be preset or user-selected, as described above. At block 712, and generally concurrently with block 706, it is determined whether the sensed temperature at the second thermal sensor exceeds a second thermal threshold. If it is decided at block 706 that the first threshold has not been exceeded, the process loops back to block 702. If it is decided at block 712 that the first threshold has not been exceeded, the process loops back to block 702. If, however, it is decided at block 706 that the first thermal threshold has been exceeded, or if it is decided at block 712 that the second thermal threshold has been exceeded, then the process advances to block 708. At block 708 the energy emitting element is electronically isolated from the power source, as an excessive heating event is occurring. Once the energy emitting element has been isolated, the process then loops back to block 704 and 710 so that it may be determined whether the excessive heating event remains. If the excessive heating event is no longer occurring, the process will loop back to block 702 and power will again be supplied to the energy emitting element.

Figure 8:
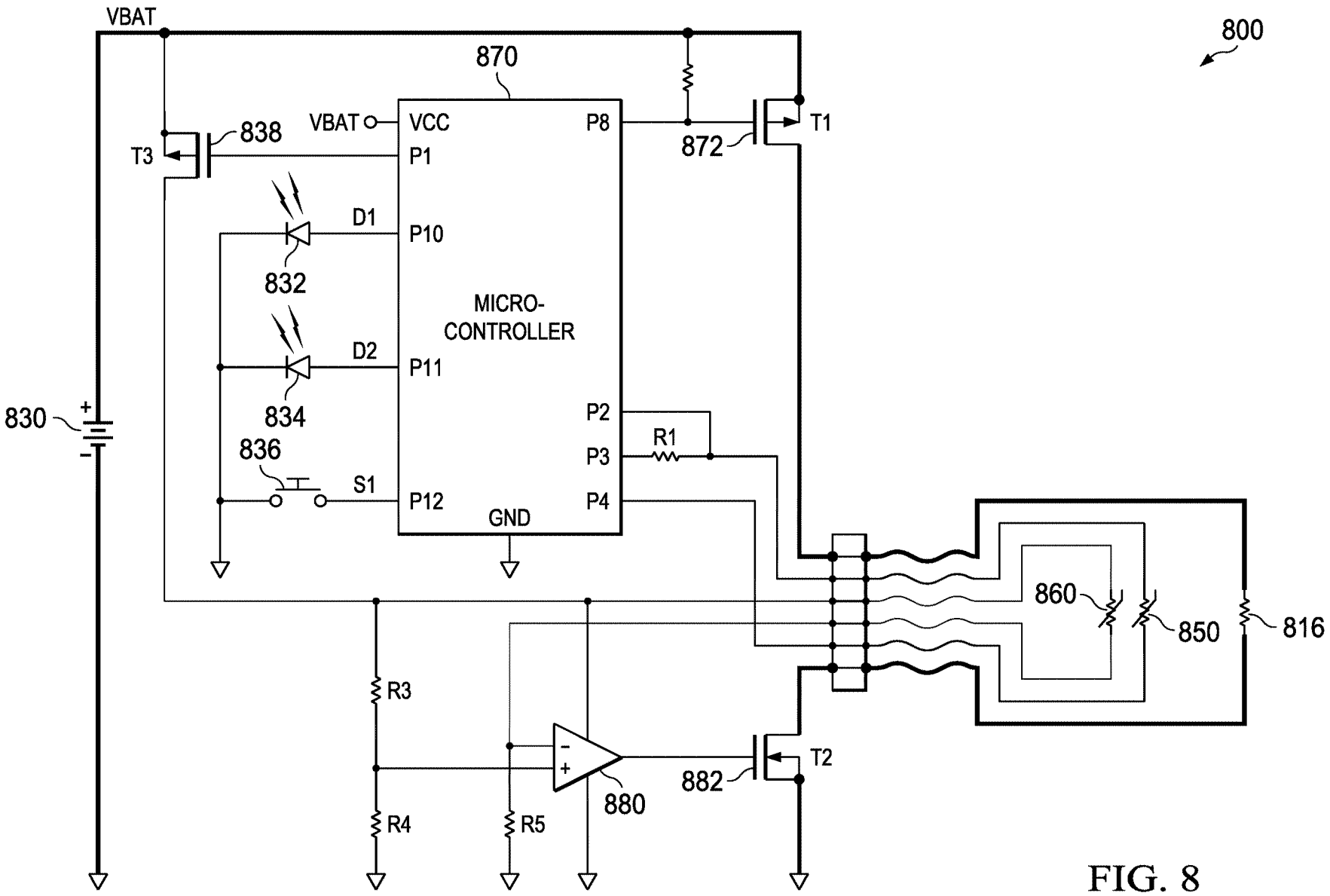
FIG. 8 is a circuit schematic for an example of a personal consumer product.

Referring now to FIG. 8, a circuit schematic 800 for an example of a personal consumer product, such as a wet-shaving razor, is shown. The circuit schematic 800 includes a first (i.e., primary) thermal control circuit and a second (i.e., redundant) thermal control circuit, similar to the block diagram shown in FIG. 3. An energy emitting element 816 is in selective electrical communication with a power source 830 through each of a first switching element 872, shown as MOSFET transistor T1, and a second switching element 882, shown as MOSFET transistor T2. The first switching element 872 is controlled by a first control unit 870 and the second switching element 882 is controlled by a second control unit, shown as a voltage comparator 880. Since the first switching element 872, the energy emitting element 816, and the second switching element 882 are in a series arrangement, if either of the first switching element 872 or the second switching element 882 is placed into a non-conductive state then the energy emitting element 816 is electrically isolated from the power source 830.

A first thermal sensor 850 and second thermal sensor 860 are each positioned proximate to the energy emitting element 816 and are each a component of the first thermal control circuit and the second thermal control circuit, respectively. The first thermal sensor 850 feeds an input to a measuring port P2 of the first control unit 870 that is representative of the sensed temperature, as the first thermal sensor 850 changes resistance with temperature. A precision resistor R1 is used to convert this resistance change into a voltage change which may be processed by first control unit 870 to monitor for excess heating events.

The first control unit 870 may selectively switch the first switching element 872 between the conductive and non-conductive states via an actuation port P8 depending on whether a threshold temperature has been reached or not, based on the input voltage at port P3. Through this thermal control circuit, the energy emitting element 816 may generally be held at a constant temperature. In addition to this temperature control function, the first control unit 870 may also manage other operations of the personal consumer product, such as by illuminating LEDs 832 and 834, monitoring the position of a power switch 836, and controlling a power supply switch 838 (shown as MOSFET transistor T3) that provides power to the redundant thermal control circuitry, for example. When the power switch 836 is depressed, the first control unit 870 switches the power supply switch 838 to a conductive state by drawing port P1 to ground, which provides power to the second thermal circuit (i.e., the voltage comparator 880). Should the first control unit 870 errantly leave the power supply switch 838 in the "off" position, the second switching element 882 will also be off and therefore prohibit current from flowing through the energy emitting element 816. Further, even if the power supply switch 838 is partly on, such as working in the linear mode with a higher drain-to-source resistance, the second thermal circuit will work properly, as the voltage difference between the inverting and non-inventing inputs (as described in more detail below) do not depend on the supply voltage.

The second thermal sensor 860 feeds a signal to the second control unit, shown as a voltage comparator 880, which is representative of the sensed temperature, as the second thermal sensor 860 changes resistance with temperature. Resistors R3 and R4 are arranged in a voltage divider and selected to place an input voltage at the non-inverting input (+) of the voltage comparator that defines a temperature threshold. The second thermal sensor 860 and resistor R5 are also arranged as a voltage divider to provide an input voltage to the inverting input (−) of the voltage comparator 880 that corresponds to the sensor temperature. As the temperature of the energy emitting element 816 rises, but is still beneath the temperature threshold, the voltage presented to the inverting input (−) of the voltage comparator 880 is lower than the voltage at the non-inverting (+) input of the voltage comparator 880. Accordingly, the output voltage of the voltage comparator 880 is substantially equal to the VBAT voltage level, which sets the second switching element 882 in a conducting state so that current can flow through the energy emitting element 816, assuming that the first switching element 872 is also in a conductive state. When the temperature increases to sufficiently raise the temperature of the second thermal sensor 860 above the temperature threshold, the output of the voltage comparator 880 will change from high to low due to the lowered resistance of the second thermal sensor 860, which causes the second switching element 882 to open. The heating element 816 will then be isolated from the power source 830 allowing it to cool. The second thermal sensor 860 will also cool and increase its resistance. Once its resistance has reached a certain level, the output of voltage comparator 880 will change from low to high, which causes the closing of the second switching element 882 and places the heating element 816 back into electrical communication with the power source 830.

Figure 9:
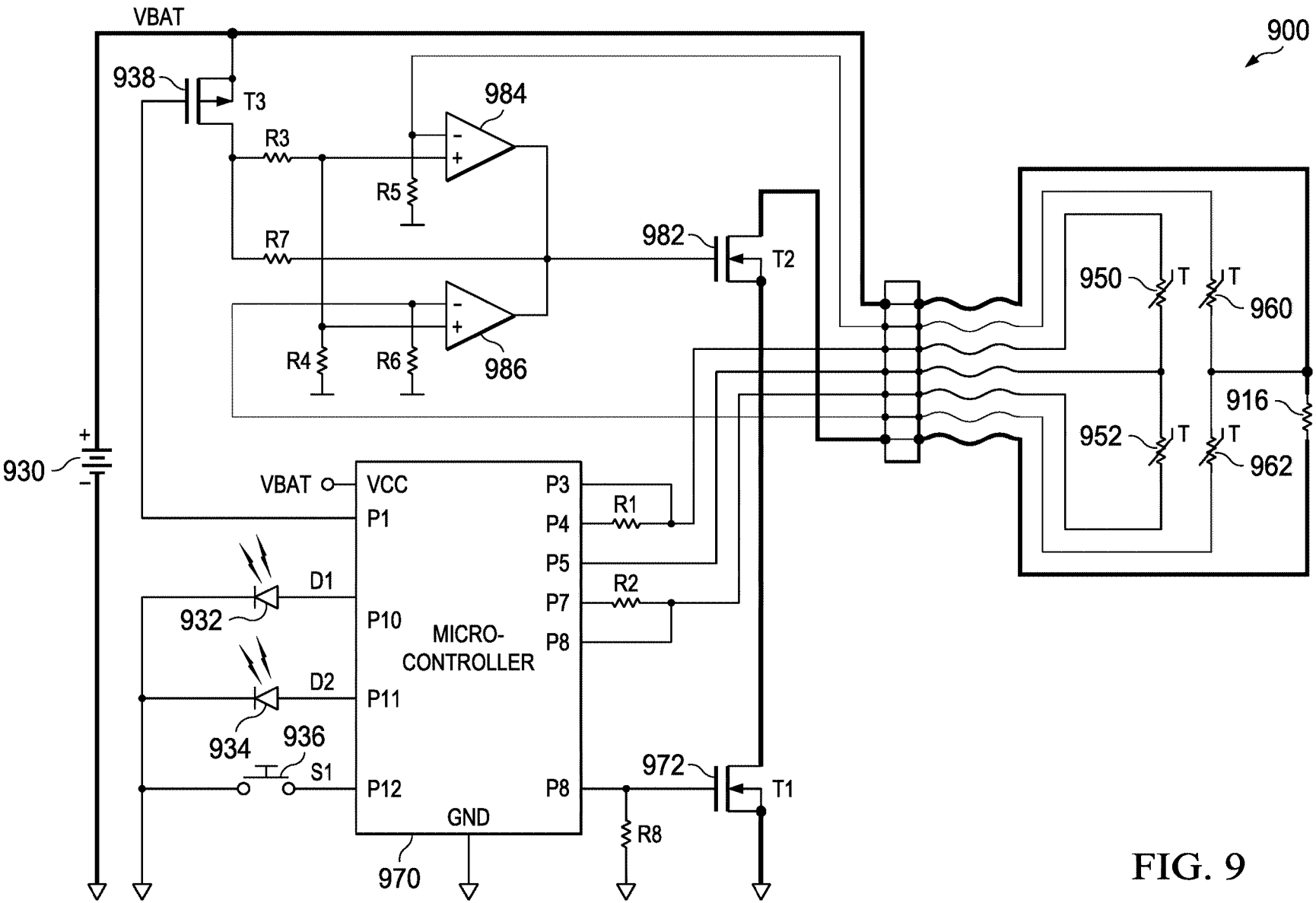
FIG. 9 is a circuit schematic for another example of a personal consumer product.

FIG. 9 shows a circuit schematic 900 for another example of a personal consumer product, which is similar to the block diagram shown in FIG. 4. An energy emitting element 916 is in selective electrical communication with a power source 930 through each of a first switching element 972, shown as MOSFET transistor T1, and a second switching element 982, shown as MOSFET transistor T2. The first switching element 972 is controlled by a first control unit 970 and the second switching element 982 is controlled by a second control unit, shown as a first voltage comparator 984 and a second voltage comparator 986. The first control unit 970 and the first switching element 972 are part of a first thermal control circuit that also includes a first thermal sensor 950 and a fourth thermal sensor 952. The first and second voltage comparators 984 and 986 and the second switching element 982 are part of a second thermal control circuit that also includes a second thermal sensor 960 and a third thermal sensor 962.

Each of the first thermal sensor 950, second thermal sensor 960, third thermal sensor 962, and fourth thermal sensor 952 are positioned proximate to the energy emitting element 916. Similar to the circuit schematic depicted in FIG. 8, the first thermal sensor 950 and the fourth thermal sensor 952 each provide inputs to measuring ports P3 and P8, respectively, of the first control unit 970 that are representative of the sensed temperature based on the resistances of the first thermal sensor 950 and the fourth thermal sensor 952. Precision resistors R1 and R2 are used to convert the resistance of these sensors into voltages which may be processed by the first control unit 970. The first control unit 970 may selectively switch the first switching element 972 between non-conducting and conducting states via an actuation port P8 depending on whether a threshold temperature has been reached. Through this first thermal control circuit, the energy emitting element 916 may generally be held at a constant temperature. In addition to this temperature control function, the first control unit 970 may also manage other operations of the personal consumer product, such as illuminating LEDs 932 and 934, monitoring the position of a power switch 936, and controlling a power supply switch 938 that provides power to the redundant thermal control circuitry, for example.

The second thermal sensor 960 provides an input to the first voltage comparator 984 and the third thermal sensor 962 provides an input to the second voltage comparator 986. The resistances of each of these thermal sensors vary based on the temperature. Resistors R3 and R4 are arranged in a voltage divider and selected to place an input voltage at the non-inverting input (+) of each of the first and second voltage comparators 984 and 986 to define a temperature threshold. The second thermal sensor 960 and resistor R5 are arranged as a voltage divider to provide an input voltage to the inverting input (−) of the first voltage comparator 984. The third thermal sensor 962 and resistor R6 are arranged as a voltage divider to provide an input voltage to the inverting input (−) of the second voltage comparator 986. The input voltage at the inverting inputs (−) of the first and second voltage comparators 984 and 986 therefore vary based on the temperature (i.e., resistance) of the second thermal sensor 960 and the third thermal sensor 962, respectively. When the temperature increases to the temperature threshold (as defined by the voltage dividers), the resistance of the second thermal sensor 960 and/or the third thermal sensor 962 will decrease to a level which causes the output of the corresponding voltage comparator 984 and/or 986 to change from high to low thereby causing the second switching element 982 to open. The heating element 916 will be isolated from the power source 930 allowing it to cool and allowing the second thermal sensor 960 and/or the third thermal sensor 962 to increase in resistance. Once the resistance of the second thermal sensor 960 and/or the third thermal sensor 962 has increased to a certain level, the originally triggered voltage comparator(s) 984 and/or 986 will change from low to high to close the second switching element 982 and place the heating element 916 back into electrical communication with the power source 930, assuming that the first switching element 972 is also in a conductive state.

Figure 10:
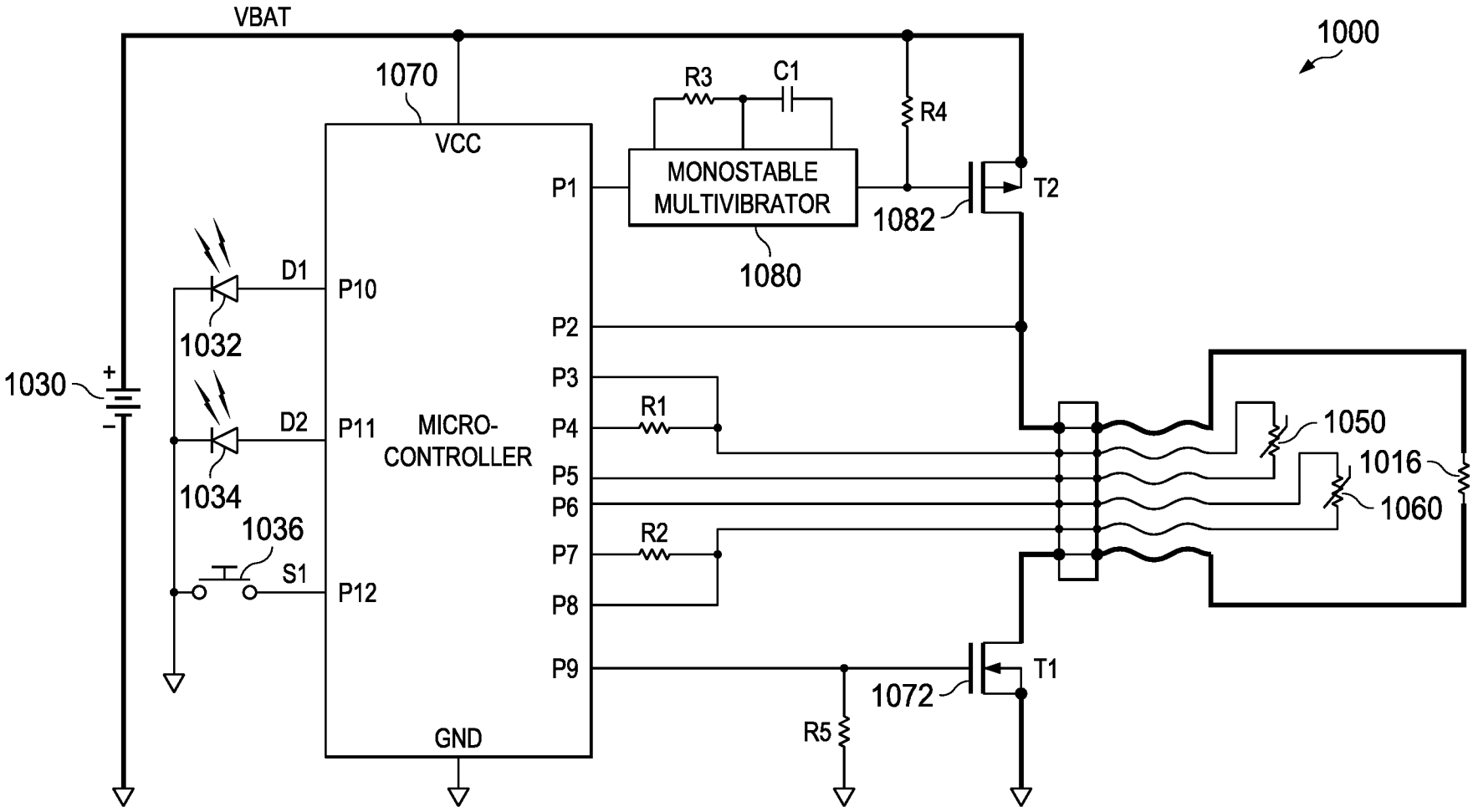
FIG. 10 is a circuit schematic for yet another example of a personal consumer product.

FIG. 10 shows a circuit schematic 1000 for another example of a personal consumer product, which is similar to the block diagram shown in FIG. 6. As depicted, multiple thermal sensors and multiple switching elements are used to provide redundancy, but the control unit is not redundant. More specifically, a second thermal sensor 1060 is redundant to a first thermal sensor 1050 and a second switching element 1082 is redundant to a first switching element 1072. The first thermal sensor 1050, which changes its resistance based on sensed temperature, feeds a voltage to a measuring port P3 of a first control unit 1070 that is representative of the sensed temperature with a precision resistor R1 converting the resistance change into a voltage change that may be processed by the first control unit 1070. The first control unit 1070 may selectively switch the first switching element 1072 between a conductive and non-conductive state via an actuation port P9 depending on whether a threshold temperature has been reached or not as determined by the voltage at measuring port P3. Through this thermal control circuit, an energy emitting element 1016 may generally be held at a constant temperature. In addition to this temperature control function, the first control unit 1070 may also manage other operations of the personal consumer product, such as illuminating LEDs 1032 and 1034, and monitoring the position of a power switch 1036, among other operations.

In the illustrated circuit schematic 1000, a monostable multivibrator 1080 (sometimes called a one-shot multivibrator) serves as a second control unit that is used to control the operational state of the second switching element 1082. Due to operationally different software processes in the first control unit 1070 that control the respective first switching element 1072 and the second switching element 1082, certain process redundancy may be achieved, as a failure of one process may not directly lead to a failure of the other process. The monostable multivibrator 1080 receives a control signal from the actuation port P1 of the first control unit 1070. The monostable multivibrator 1080 generates an output that is used to control the second switching element 1082, which is a p-MOSFET transistor in the illustrated embodiment. When the output signal of the monostable multivibrator 1080 is low, the second switching element 1082 is closed (i.e., in a conductive state) allowing current to flow through the energy emitting element 1016. The output of the monostable multivibrator 1080 is switched on for a defined time period after receiving an input signal on the input of the monostable multivibrator 1080. This input signal is periodically provided by the first control unit 1070 via the activation port P1. The duration of the output signal of the monostable multivibrator 1080 is defined by a timing circuit comprising a resistor R3 and a capacitor C1. The duration of the output signal of the monostable multivibrator 1080 may be slightly longer than the period of the trigger signal created by the activation port P1 of the first control unit 1070. Thus, as long as the first control unit 1070 properly functions and creates the trigger signal with the desired frequency, the output of the monostable multivibrator 1080 remains low to maintain the second switching element 1082 in a conductive state. If the first control unit 1070 fails to create the trigger signal in time (i.e., in response to an increased voltage input at port P7 provided by the second thermal sensor 1060 and precision resistor R2 or as a result of a software related issue, such as when a process of the control unit hangs, for example), the monostable multivibrator 1080 will provide an output that will switch the second switching element 1082 to an open (i.e., non-conductive) state to isolate the energy emitting element 1016 from the power source.

EXAMPLES

A. A personal consumer product, comprising:
  a. a power source;
  b. an energy emitting element in selective electrical communication with the power source;
  c. a first thermal control circuit, the first thermal control circuit comprising:
    i. a first thermal sensor positioned to sense a temperature of the energy emitting element;
    ii. a first control unit in electrical communication with the first thermal sensor;
    iii. a first switching element in electrical communication with the first control unit, the first switching element switchable by the first control unit between a conducting state and a non-conducting state to electrically isolate the energy emitting element from the power source, wherein the first switching element is switched by the first control unit to the non-conducting state when a first sensed temperature of the energy emitting element exceeds a first thermal threshold; and d. a second thermal control circuit, the second thermal control circuit comprising:

i. a second thermal sensor positioned to sense the temperature of the energy emitting element;

ii. a second control unit in electrical communication with the second thermal sensor;

iii. a second switching element in electrical communication with the second thermal sensor, the second switching element switchable by the second control unit between a conducting state and a non-conducting state to electrically isolate the energy emitting element from the power source, wherein the second switching element is switched to the non-conducting state by the second control unit when a second sensed temperature of the energy emitting element exceeds a second thermal threshold.

B. A personal consumer product according to Paragraph A, wherein the second control unit is any of a voltage comparator and a monostable multivibrator and wherein the energy emitting element is any of a light emitting diode, a heating element, and a laser element.

C. A personal consumer product according to Paragraph B, wherein the second control unit is a first voltage comparator to compare an output of the second thermal sensor to a reference signal corresponding to the second thermal threshold.

D. A personal consumer product according to Paragraph B or C, wherein the second thermal control circuit further comprises:

i. a third thermal sensor positioned to sense the temperature of the energy emitting element;

ii. a second voltage comparator in electrical communication with the third thermal sensor and the second switching element, the second switching element switchable by the second voltage comparator from the conducting state to the non-conducting state, wherein the second switching element is switched to the non-conducting state by the second voltage comparator when a third sensed temperature of the energy emitting element exceeds a third thermal threshold.

E. A personal consumer product according to Paragraph D, wherein the first thermal control circuit further comprises:

i. a fourth thermal sensor positioned to sense the temperature of the energy emitting element, wherein the first control unit is in electrical communication with the fourth thermal sensor, and wherein the first switching element is switched to the non-conducting state by the first control unit when a fourth sensed temperature of the energy emitting element exceeds a fourth thermal threshold.

F. A personal consumer product according to Paragraph E, wherein the first thermal threshold and the fourth thermal threshold are substantially equal and the second thermal threshold and the third thermal threshold are substantially equal.

G. A personal consumer product according to Paragraph E or F, wherein the first thermal threshold and the fourth thermal threshold are each lower than each of the second thermal threshold and the third thermal threshold.

H. A personal consumer product according to any one of Paragraphs E-G, wherein the second thermal threshold and the third thermal threshold are each lower than each of the first thermal threshold and the fourth thermal threshold.

I. A personal consumer product according to any one of Paragraphs A-H, wherein first thermal sensor generates a first reference output based on sensed temperature and the second thermal sensor generates a second reference output based on sensed temperature, wherein the first reference output is received by the first control unit, and the second reference output is received by the second control unit.

J. A personal consumer product according to any one of Paragraphs A-I, wherein the first switching element and the second switching element are connected in series with the energy emitting element.

K. A personal consumer product according to any one of Paragraphs A-J, wherein the first thermal control circuit is a primary thermal control circuit and the second thermal control circuit is a redundant thermal control circuit.

L. A method for controlling the temperature of an energy emitting element of a personal consumer device, the method comprising:

a. supplying power to the energy emitting element from a power source, wherein a first thermal sensor is positioned proximate to the energy emitting element to sense the temperature of the energy emitting element and generate a first thermal sensor output and a second thermal sensor is positioned proximate to the energy emitting element to sense the temperature of the energy emitting element and generate a second thermal sensor output;

b. receiving the first thermal sensor output at a first control unit, wherein the first thermal sensor output corresponds to the temperature of the energy emitting element sensed by the first thermal sensor;

c. when the temperature of the energy emitting element sensed by the first thermal sensor exceeds a first thermal threshold, electrically isolating the energy emitting element from the power source;

d. receiving the second thermal sensor output at a second control unit, wherein the second thermal sensor output corresponds to the temperature of the energy emitting element sensed by the second thermal sensor; and e. when the temperature of the energy emitting element sensed by the second thermal sensor exceeds a second thermal threshold, electrically isolating the energy emitting element from the power source.

M. A method according to Paragraph L, wherein supplying power to the energy emitting element from the power source comprises:

a. supplying power through a first switching element in a conductive state and a second switching element in a conductive state, wherein the first switching element and the second switching element are connected in series with the energy emitting element.

N. A method according to Paragraph M, wherein electrically isolating the energy emitting element from the power source when the temperature of the energy emitting element sensed by the first thermal sensor exceeds the first thermal threshold comprises:

a. switching the first switching element to a non-conductive state by the first control unit.

O. A method according to Paragraph N, wherein electrically isolating the energy emitting element from the power source when the temperature of the energy emitting element sensed by the second thermal sensor exceeds the second thermal threshold comprises:

a. switching the second switching element to a non-conductive state by the second control unit.

P. A method according to Paragraph O, wherein a third thermal sensor is positioned proximate to the energy emitting element to sense the temperature of the energy emitting element and generate a third thermal sensor output and a fourth thermal sensor is positioned proximate to the energy emitting element to sense the temperature of the energy emitting element and generate a fourth thermal sensor output, the method further comprising:

a. receiving the third thermal sensor output at the second control unit, wherein the third thermal sensor output corresponds to the temperature of the energy emitting element sensed by the third thermal sensor;

b. when the temperature of the energy emitting element sensed by the third thermal sensor exceeds a third thermal threshold, switching the second switching element to a non-conductive state to electrically isolate the energy emitting element from the power source;

c. receiving the fourth thermal sensor output at a first control unit, wherein the fourth thermal sensor output corresponds to the temperature of the energy emitting element sensed by the fourth thermal sensor; and d. when the temperature of the energy emitting element sensed by the fourth thermal sensor exceeds a fourth threshold, switching the first switching element to a non-conductive state to electrically isolate the energy emitting element from the power source.

Q. A method according to Paragraph P, wherein the second thermal threshold and the third thermal threshold are substantially equal and the first thermal threshold and the fourth thermal threshold are substantially equal.

R. A method according to Paragraph Q wherein the second thermal threshold and the third thermal threshold are each higher than each of the first thermal threshold and the fourth thermal threshold.

S. A method according to any one of Paragraphs L-R, wherein the first control unit is a microcontroller and the second control unit is any of a voltage comparator and a monostable multivibrator.

T. A personal consumer product, comprising:

a. a power source;

b. a user input device;

c. an energy emitting element in selective electrical communication with the power source;

d. a first thermal control circuit, the first thermal control circuit comprising:

i. a first thermal sensor positioned to sense a temperature of the energy emitting element;

ii. a first control unit in electrical communication with the first thermal sensor and the user input device, wherein the user input device is to provide a user control signal to the first control unit;

iii. a first switching element in electrical communication with the first control unit, the first switching element switchable by the first control unit between a conducting state and a non-conducting state to electrically isolate the energy emitting element from the power source, wherein the first switching element is switched by the first control unit to the non-conducting state when a first sensed temperature of the energy emitting element exceeds an adjustable first thermal threshold, wherein the adjustable first thermal threshold is based on the user control signal; and e. a second thermal control circuit, the second thermal control circuit comprising:

i. a second thermal sensor positioned to sense the temperature of the energy emitting element;

ii. a second control unit in electrical communication with the second thermal sensor;

iii. a second switching element in electrical communication with the second thermal sensor, the second switching element switchable by the second control unit between a conducting state and a non-conducting state to electrically isolate the energy emitting element from the power source, wherein the second switching element is switched to the non-conducting state by the second control unit when a second sensed temperature of the energy emitting element exceeds a second thermal threshold.

U. A personal consumer product according to Paragraph T, wherein the adjustable first thermal threshold is adjustable between a minimum thermal threshold and a maximum thermal threshold, and wherein the maximum thermal threshold is less than or equal to the second thermal threshold.

V. A personal consumer product according to Paragraph T or U, wherein the first control unit is a microcontroller and the second control unit is any of a voltage comparator and a monostable multivibrator.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for controlling the temperature of an energy emitting element of a personal consumer device, the method comprising:

supplying power to the energy emitting element from a power source, wherein a first thermal sensor is positioned proximate to the energy emitting element to sense the temperature of the energy emitting element and generate a first thermal sensor output and a second thermal sensor is positioned proximate to the energy emitting element to sense the temperature of the energy emitting element and generate a second thermal sensor output;

receiving the first thermal sensor output at a first control unit, wherein the first thermal sensor output corresponds to the temperature of the energy emitting element sensed by the first thermal sensor;

when the temperature of the energy emitting element sensed by the first thermal sensor exceeds a first thermal threshold, electrically isolating the energy emitting element from the power source;

receiving the second thermal sensor output at a second control unit, wherein the second thermal sensor output corresponds to the temperature of the energy emitting element sensed by the second thermal sensor; and when the temperature of the energy emitting element sensed by the second thermal sensor exceeds a second thermal threshold, electrically isolating the energy emitting element from the power source, wherein a third thermal sensor is positioned proximate to the energy emitting element to sense the temperature of the energy emitting element and generate a third thermal sensor output and a fourth thermal sensor is positioned proximate to the energy emitting element to sense the temperature of the energy emitting element and generate a fourth thermal sensor output, the method further comprising:

receiving the third thermal sensor output at the second control unit, wherein the third thermal sensor output corresponds to the temperature of the energy emitting element sensed by the third thermal sensor;

when the temperature of the energy emitting element sensed by the third thermal sensor exceeds a third thermal threshold, switching the second switching element to a non-conductive state to electrically isolate the energy emitting element from the power source;

receiving the fourth thermal sensor output at a first control unit, wherein the fourth thermal sensor output corresponds to the temperature of the energy emitting element sensed by the fourth thermal sensor; and when the temperature of the energy emitting element sensed by the fourth thermal sensor exceeds a fourth threshold, switching the first switching element to a non-conductive state to electrically isolate the energy emitting element from the power source.

2. The method of claim 1, wherein supplying power to the energy emitting element from the power source comprises:

supplying power through a first switching element in a conductive state and a second switching element in a conductive state, wherein the first switching element and the second switching element are connected in series with the energy emitting element.

3. The method of claim 2, wherein electrically isolating the energy emitting element from the power source when the temperature of the energy emitting element sensed by the first thermal sensor exceeds the first thermal threshold comprises:

switching the first switching element to a non-conductive state by the first control unit.

4. The method of claim 3, wherein electrically isolating the energy emitting element from the power source when the temperature of the energy emitting element sensed by the second thermal sensor exceeds the second thermal threshold comprises:

switching the second switching element to a non-conductive state by the second control unit.

5. The method of claim 4, wherein the second thermal threshold and the third thermal threshold are substantially equal and the first thermal threshold and the fourth thermal threshold are substantially equal.

6. The method of claim 5, wherein the second thermal threshold and the third thermal threshold are each higher than each of the first thermal threshold and the fourth thermal threshold.

7. The method of claim 1, wherein the first control unit is a microcontroller and the second control unit is any of a voltage comparator and a monostable multivibrator.

* * * * *